US006890086B2

(12) United States Patent
Shiu

(10) Patent No.: US 6,890,086 B2
(45) Date of Patent: May 10, 2005

(54) ELECTRONICALLY CONTROLLED MULTI-LIGHT FLASHLIGHT

(75) Inventor: Stephanie Wai Man Shiu, Kowloon (HK)

(73) Assignee: Gold Coral International Limited, Kowloon (HK)

( * ) Notice: Subject to any disclaimer, the term of this patent is extended or adjusted under 35 U.S.C. 154(b) by 135 days.

(21) Appl. No.: 10/029,482

(22) Filed: Dec. 20, 2001

(65) Prior Publication Data

US 2003/0117799 A1 Jun. 26, 2003

(51) Int. Cl.[7] ..... F21V 23/04
(52) U.S. Cl. ..... 362/251; 362/227; 362/800
(58) Field of Search ..... 362/251, 234, 362/800, 227, 228, 249, 184, 205; 340/332, 815.4; 315/193, 200 A, 209 R, 312–315

(56) References Cited

U.S. PATENT DOCUMENTS 5,347,261 A * 9/1994 Adell ..... 340/469
5,903,103 A * 5/1999 Garner ..... 315/76
6,012,824 A * 1/2000 Sharrah et al. ..... 362/199
6,305,818 B1 * 10/2001 Lebens et al. ..... 362/184
6,394,622 B1 * 5/2002 Macek ..... 362/228
2002/0084890 A1 * 7/2002 Guerrieri et al. ..... 340/332

* cited by examiner

*Primary Examiner*—Sandra O'Shea
*Assistant Examiner*—Mark Tsidulko
(74) *Attorney, Agent, or Firm*—Mitchell Silberberg & Knupp LLP

(57) ABSTRACT

Provided is a flashlight that includes a plurality of light sources for providing a beam of light. Preferably, the light sources have different levels of power consumption, different brightnesses and/or different beam lengths. More preferably, the plurality of light sources includes at least one light-emitting diode (LED) and at least one incandescent lamp. A housing directs the beam of light and an integrated circuit controls illumination of the plurality of light sources, with a switch providing an input signal to the integrated circuit. In the preferred embodiment of the invention, the switch is a pushbutton switch and the integrated circuit is a multi-state electronic device that changes state when the signal is input from the switch, with different states of the integrated circuit causing different combinations of the light sources to become illuminated.

26 Claims, 3 Drawing Sheets

ELECTRONICALLY CONTROLLED MULTI-LIGHT FLASHLIGHT

BACKGROUND OF THE INVENTION

1. Field of the Invention

The present invention concerns flashlights and is particularly directed to a flashlight having multiple light sources that are electronically controlled.

2. Description of the Related Art

Most conventional flashlights are simple mechanical devices that include a battery compartment, a single light bulb and a switch for opening and closing the electrical circuit between the battery and the light bulb. However, some conventional flashlights include multiple light bulbs and have a switch with additional contact positions to accommodate such multiple light bulbs.

For instance, a flashlight with two bulbs might include a switch with three positions (e.g., an off position, a position in which only the first light bulb is illuminated and a position in which only the second light bulb is illuminated). In such a case, the middle position is usually the off position, sliding or rotating the switch to one side turns on the first light, and sliding or rotating the switch to the other side turns on the second light.

Alternatively, a flashlight with two bulbs might include a switch with four positions (e.g., two off positions, a position in which only the first light bulb is illuminated and a position in which only the second light bulb is illuminated). For example, such a switch might be a rotating switch having the off contacts at the 0° and 180° orientations and the on contacts at the 90° and 270° orientations.

SUMMARY OF THE INVENTION

While such conventional flashlights are adequate to a point, the present inventor has discovered a number of deficiencies in such conventional designs. For instance, the single-bulb flashlight generally has no flexibility in terms of brightness, beam length or power consumption. Conventional multi-light flashlights, on the other hand, typically require multiple-contact switches, which often are more prone to becoming defective, and which limit the flashlight's flexibility to turn on the lights in different combinations.

The present invention addresses these problems by providing a flashlight that has multiple light sources and utilizes an integrated circuit or a multi-state electronic device in connection with a switch to control such multiple light sources.

Thus, in one aspect the invention is directed to a flashlight that includes a plurality of light sources for providing a beam of light. Preferably, the light sources have different levels of power consumption, different brightnesses and/or different beam lengths. More preferably, the plurality of light sources includes at least one light-emitting diode (LED) and at least one incandescent lamp. A housing directs the beam of light and an integrated circuit controls illumination of the plurality of light sources, with a switch providing an input signal to the integrated circuit. In the preferred embodiment of the invention, the switch is a pushbutton switch and the integrated circuit is a multi-state electronic device that changes state when the signal is input from the switch, with different states of the integrated circuit causing different combinations of the light sources to become illuminated.

In a further aspect, the invention is directed to a flashlight that includes a hand-sized flashlight body having plural light sources disposed within it. A switch is disposed on the flashlight body, and a multi-state electronic device that has plural states is electrically coupled to the switch and to the plural light sources. According to this aspect of the invention, the flashlight body is configured to direct light from the plural light sources, each activation of the switch causes the multi-state electronic device to advance to a next one of the plural states, and each of the plural states causes a different combination of the light sources to illuminate.

A flashlight having any of the foregoing arrangements often provides a user with the ability to control one or more different aspects of a flashlight beam and/or power consumption of the flashlight while using a simple switch. As a result, the flashlight can be made very flexible and yet easy to use. At the same time, the use of a simple switch frequently may avoid many mechanical problems associated with more complicated switches.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
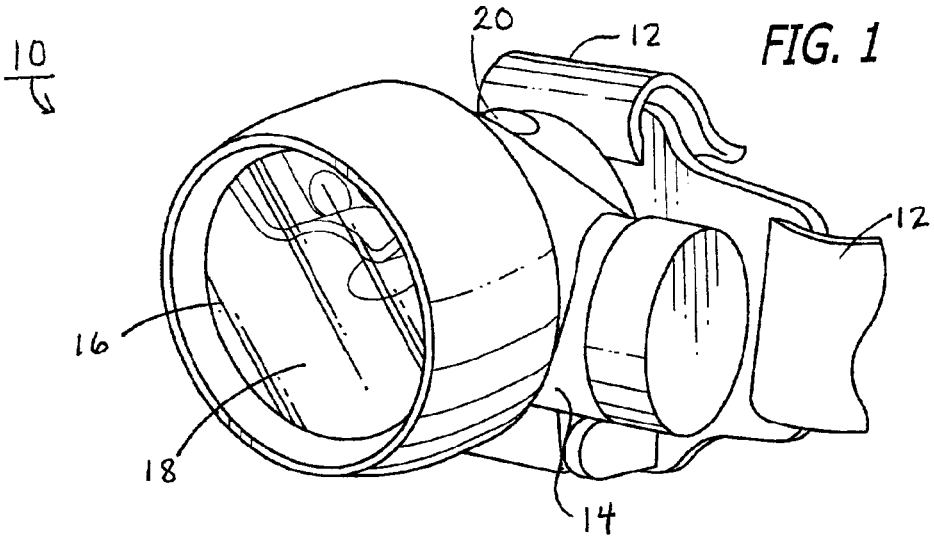
FIG. 1 is perspective view of a flashlight according to the present invention.

FIG. 1 illustrates a perspective view of a flashlight according to a representative embodiment of the present invention. As used herein, a flashlight is intended to mean any small (typically hand-sized) battery-powered device for producing a beam of light. In the embodiment shown in FIG. 1, the flashlight is configured as a headlight that is intended to be worn, using straps 12, on the user's head. However, a flashlight according to the present invention may be any other type of flashlight, such as a hand-held flashlight, a clip-on flashlight or a keychain flashlight.

In the current embodiment, flashlight 10 includes a hand-sized flashlight body 14 that is opaque on all sides other than side 16. Covering side 16 is a clear plastic lens 18 which permits light to exit flashlight 10. In this way, flashlight 10 is configured to produce a beam of light in a single direction (i.e., from side 16).

Included on flashlight body 14 is a switch 20 for operating flashlight 10. In the preferred embodiment of the invention, switch 20 is a simple spring-loaded pushbutton switch that closes a circuit when depressed and springs back to the open position when pressure is released. Switch 20 may be any other type of switch. However, as will become apparent below, it generally will be preferable to utilize a switch that closes only temporarily in response to an action by the user, rather than a switch that can be placed into a continuous closed position. Thus, switch 20 preferably could, for example, be any other type of spring-loaded switch, touch-sensitive switch or similar device.

Figure 2:
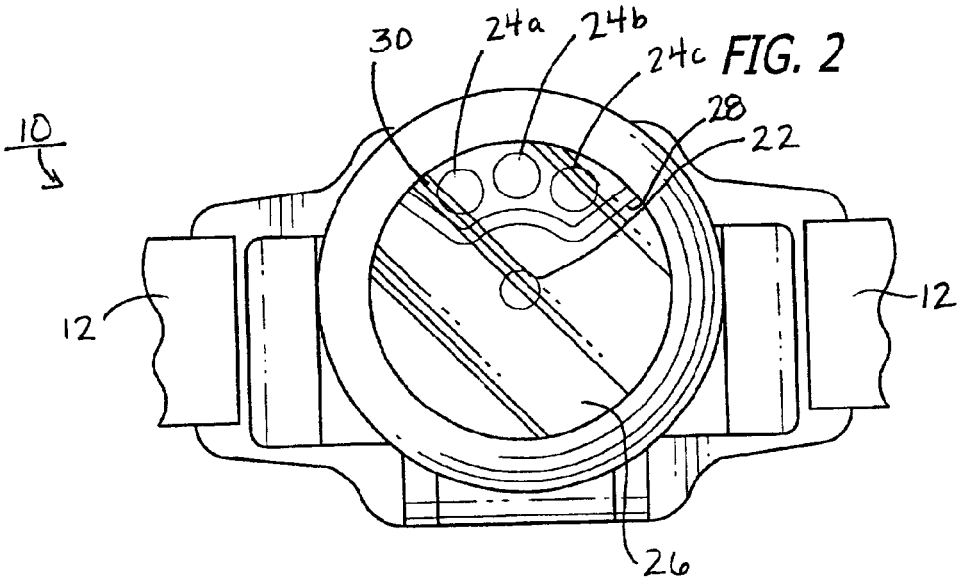
FIG. 2 is a front elevational view of the flashlight shown in FIG. 1.

FIG. 2 illustrates a front elevational view of flashlight 10. In the present embodiment of the invention, flashlight 10 includes a single incandescent light bulb 22 and three light-emitting diodes (LEDs) 24*a* to 24*c*. Any other number or combination of incandescent light bulbs, LEDs, and/or any other type of light source may instead be used. However, it is generally preferable to use light sources that have different power consumptions, different brightnesses, and/or different beam lengths. In the present embodiment, all of LEDs 24 are identical. However, this is not necessary and in alternate embodiments LEDs having different properties, such as different brightnesses, different beam lengths, different power consumptions, and/or even different colors, may instead be used.

Disposed behind incandescent light bulb 22 is a parabolic reflector 26 that reflects the light emanating from bulb 22 out of the front side 16 of flashlight 10. In the preferred embodiment of the invention, reflector 26 is not fully parabolic, but instead has a portion 28 that has been cut away. Fitting within cutout portion 28 is a lens 30 that covers all of LEDs 24. As a result of this arrangement, it is possible to focus the light from LEDs 24 differently than the light from incandescent bulb 22.

Figure 3:
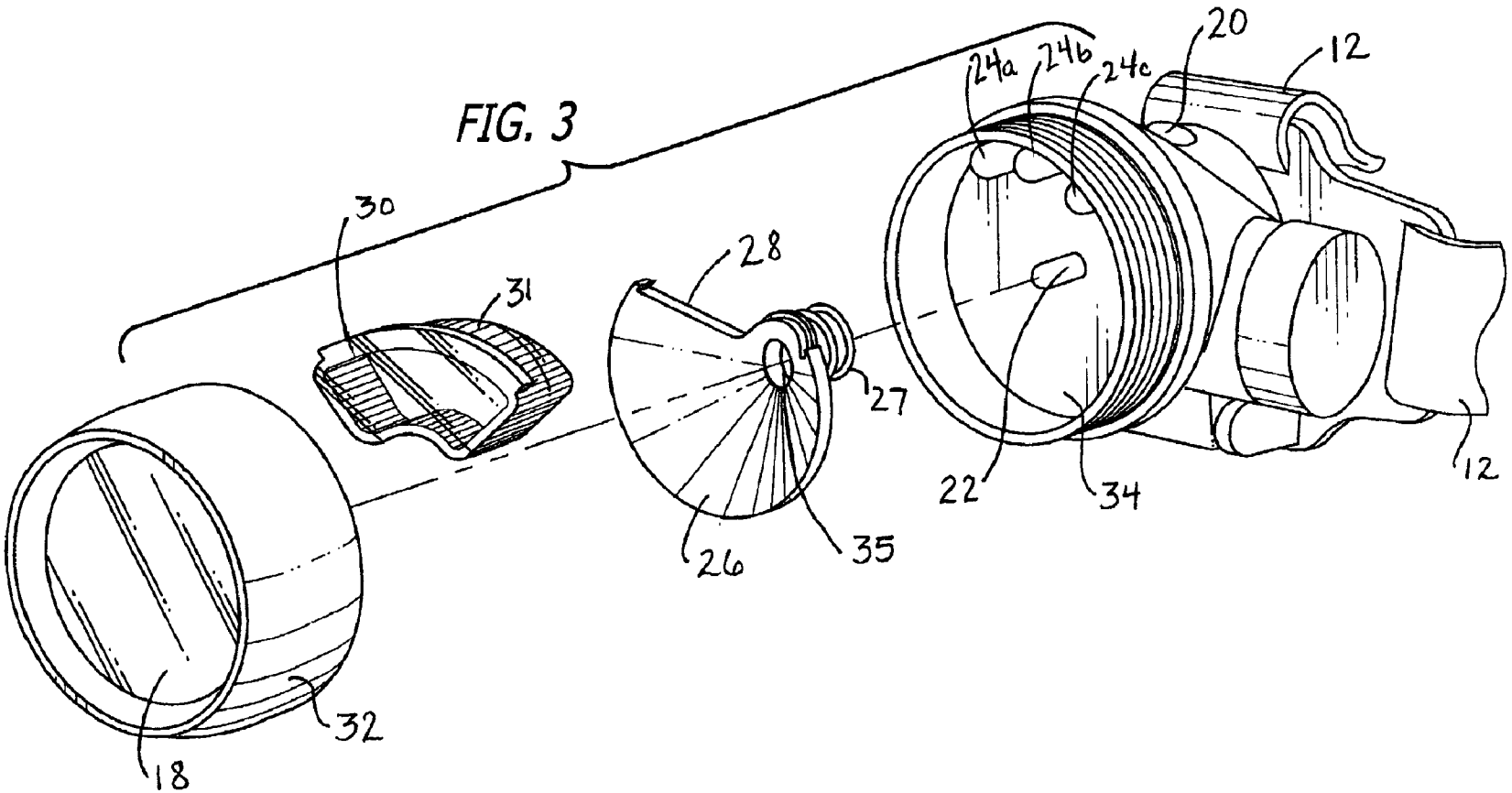
FIG. 3 is an exploded view of the flashlight shown in FIG. 1.

This configuration is shown more clearly in FIG. 3, which illustrates an exploded view of flashlight 10. As shown in FIG. 3, cover 32, which includes lens 18 can be unscrewed from the rest of flashlight body 14. Cut-away parabolic reflector 26 is provided with a spring 27 that fits over incandescent light bulb 22. Lens 30 then fits within cutout portion 28 so as to cover LEDs 24. When cover 32 is then reattached to the rest of flashlight body 14, parabolic reflector 26 seats against the inner edge of cover 32, causing spring 27 to be pressed against the inner surface 34 of flashlight housing 14, thus causing light bulb 22 to protrude through hole 35 in parabolic reflector 26.

As shown in FIG. 3, the walls 31 of lens 30 preferably are ribbed so as to reflect back some of the light that would otherwise have escaped from LEDs 24. However, any other reflective means may instead be used or such reflective means may be omitted. Similarly, inner surface 34 also may be made reflective, at least in the area of LEDs 24, for the same reasons.

Figure 4:
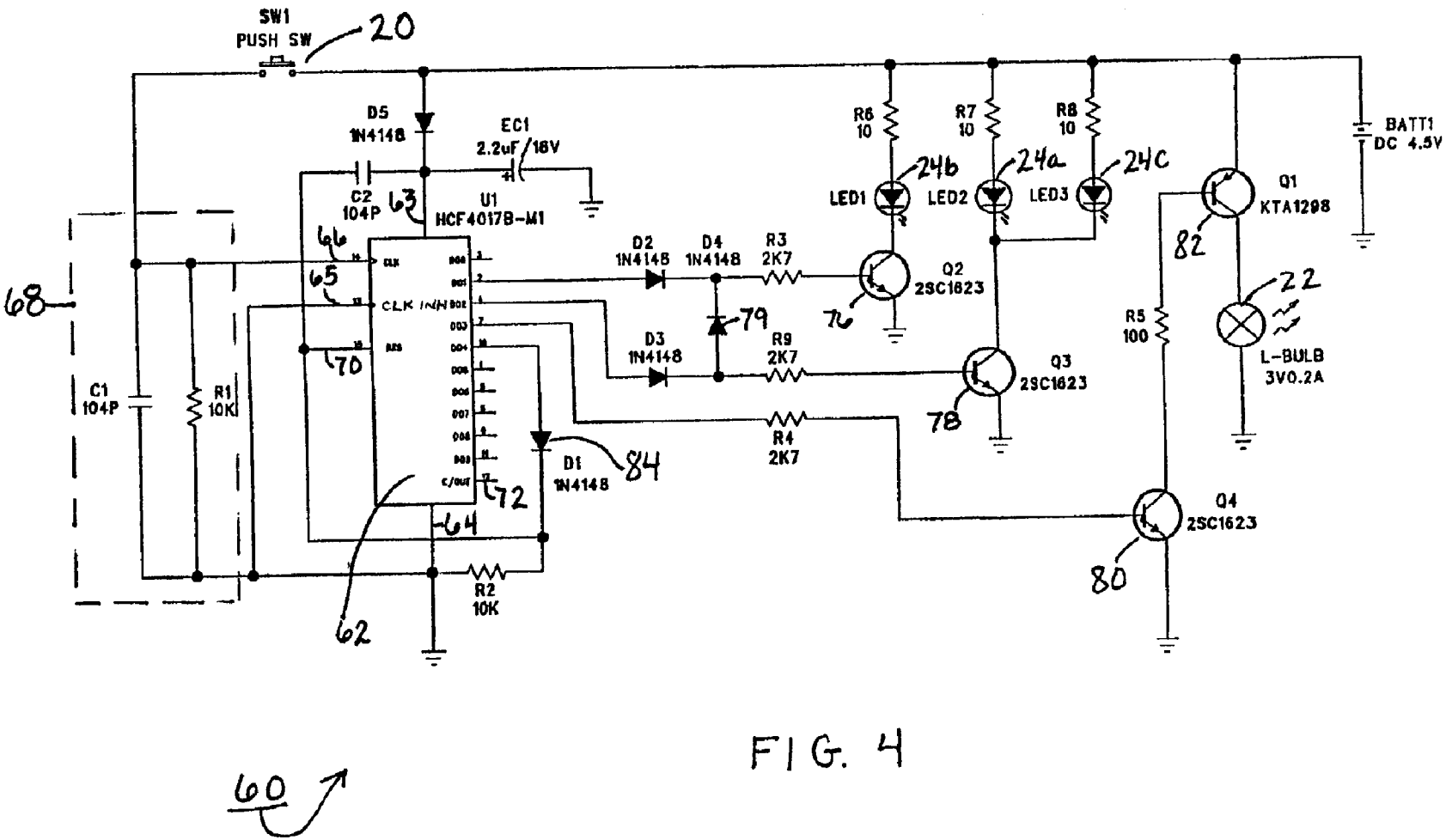
FIG. 4 is an electrical schematic illustrating a control circuit according to the present invention.

FIG. 4 illustrates an electronic control circuit that may be used in flashlight 10 in a representative embodiment of the present invention. The main control unit in circuit 60 is integrated circuit (IC) 62. Preferably, IC 62 is a multi-state electronic device and, more preferably, is a counter. In the present embodiment, IC 62 is a SGS-Thomson Microelectronics HCF4017B 5-stage Johnson counter having ten decoded outputs (D00 to D09). Power and ground are supplied to IC 62 at pins 63 and 64, respectively. Clock inhibit pin 65 of IC 62 is tied to ground so that each clock pulse input into IC 62 advances the counter one state. In this regard, clock pulses are input into IC 62 at pin 66 under the control of pushbutton switch 20 through RC circuit 68. RC circuit 68 acts as a low-pass filter to eliminate any bounce that might occur upon the opening or closing of switch 20, thereby eliminating erroneous state advances. Here, the RC time constant associated with RC filter 68 is set to be approximately 1 microsecond. However, the time constant can be adjusted based on the physical properties of switch 20.

In the present embodiment, with its clock inhibit signal 65 tied low, IC 62 functions as follows. Only one of the outputs D00 through D09 is high at any given time, starting with D00. On each positive clock signal transition (i.e., the leading edge of each clock pulse), IC 62 advances its state by one count. Thus, assuming that D00 is initially high, the first positive clock signal transition causes D00 to go low and D01 to go high. The next positive clock signal transition causes D01 to go low and D02 to go high. This process continues until either a high signal is applied at reset pin 70 of IC 62 (in which case the state of IC 62 is forced back to state D00) or D09 is high and a positive clock signal transition is input at pin 66 (in which case D09 goes low, D00 goes high and the carry-out pin 72 goes high).

As can be seen in FIG. 4, D00 is unconnected in circuit 60. Thus, it is the off state for flashlight 10. When pushbutton 20 is depressed a positive clock signal transition is input into pin 66, causing D00 to go low and D01 to go high. It is noted that releasing pushbutton 20 merely results in a negative clock signal transition, which does not affect the state of IC 62. Once D01 goes high, transistor 76 is turned on, causing current to flow through and illuminate LED 24*b*.

Another depression of pushbutton switch 20 causes pin D01 to go low and pin D02 to go high. The D02 signal turns on transistor 78 and, through diode 79, transistor 76 also. As a result, current flows through and illuminates all of LEDs 24*a* through 24*c*.

Another depression of pushbutton switch 20 causes D02 to go low and D03 to go high. As a result, only transistor 80 is turned on, causing transistor 82 to turn on and current to flow through and illuminate incandescent light bulb 22.

The next depression of pushbutton switch 20 causes D03 to go low and D04 to go high. As shown in FIG. 4, the D04 signal is routed through diode 84 to reset pin 70 of IC 62. As a result, the state of IC 62 is forced back to D00 (the off state).

The operation of circuit 60 can therefore be summarized as follows. From an initial off state, the first depression of pushbutton switch 20 causes one of the LEDs 24 to be illuminated (preferably, in the current embodiment, the middle LED). A further depression of pushbutton switch 20 causes all three LEDs 24 to become illuminated. The next depression of pushbutton switch 20 causes all three LEDs 24 to be turned off and incandescent light bulb 22 to be turned on. A final depression of pushbutton switch 20 returns flashlight 10 to the off state with no light sources being illuminated. Thereafter, the cycle may be repeated, if desired.

As a result of the foregoing arrangement, a simple mechanical or other type of switch can be used to control the illumination of a plurality of different light sources. As noted above, such light sources preferably have different brightnesses, power consumptions, beam lengths, colors or other characteristics, thereby giving the user a wide variety of different illumination choices.

In the preceding embodiment of the invention, certain combinations of light sources are turned on and off at each state of IC 62. However, it should be understood that any other combinations of light sources may be turned on and off at each state and/or various other numbers states may instead be used, by simply routing the output signals D00 through D09 (and in certain embodiments carry-out signal 72) to the desired combinations of light sources.

In the preferred embodiment of the invention, a counter that counts up on each positive clock transition is used to control such illumination. However, any other type of counter may instead be used. For example, by using a three-position switch (e.g., a rocker switch) in connection with a counter circuit that is capable of both incrementing and decrementing a count, a user might have the ability, for example, to change the brightness, beam length, power consumption, color or other characteristic of the light beam in one direction (i.e., up or down) by depressing the switch to one side and to change such characteristic in the other direction by simply depressing the switch to the opposite side.

Also, it is not critical to use a counter. Instead, any other multi-state electronic device may be used in place of a counter, with the specific electronic device being selected based upon the desired switching pattern. Still further, although the above-described embodiment of the present invention switches the various light sources on and off in a binary fashion, it is also possible to modify the above circuit such that different states apply different levels of electrical current to the same light source, as will be understood by those skilled in the art.

In the above embodiment, the LEDs are covered by a lens that does not cover the incandescent bulb. However, the use of a lens to cover some light sources but not others in the present invention is not so limited. Although it might be preferable to cover the same types of light sources with a lens while not covering other light sources of a different type, the selective use of a lens or any other type of optical processing for different light sources may be used to achieve any desired effect.

Finally, although the above-described embodiments apply to flashlights, it should be understood that the teachings of the present invention may be applied to other light-producing devices as well.

Additional Considerations.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

What is claimed is:

1. A flashlight, comprising:

a plurality of light sources, each providing light when energized;

a housing configured so as to direct the light into a beam;

an integrated circuit configured to control which of the plurality of light sources is/are illuminated; and a pushbutton switch operable by a user and electrically coupled to the integrated circuit, wherein the integrated circuit controls illumination of the light sources based on input signals from the pushbutton switch, wherein the integrated circuit is a multi-state electronic device that chances state when a signal is input from the switch, and wherein different states of the integrated circuit cause different combinations of the light sources to become illuminated, wherein the integrated circuit cycles through a fixed number of states, one state each time the pushbutton switch is depressed, and wherein the states begin at an initial state in which all of the light sources are off and then, after cycling through the fixed number of states, return to said initial state, whereupon the cycle may be repeated.

2. A flashlight according to claim 1, wherein the light sources have different levels of power consumption.

3. A flashlight according to claim 1, wherein the plurality of light sources includes at least one light-emitting diode (LED) and at least one incandescent lamp.

4. A flashlight according to claim 1, wherein the integrated circuit is a counter.

5. A flashlight according to claim 1, wherein at least one of the light sources is covered by a type of lens that does not cover at least one other of the light sources.

6. A flashlight according to claim 1, wherein the light sources include plural light-emitting diodes (LEDs) and an incandescent bulb, and wherein a lens covers all of the LEDs only.

7. A flashlight according to claim 1, wherein the flashlight is hand-sized and battery-powered.

8. A flashlight according to claim 1, wherein each time the switch is activated the integrated circuit causes a change in which of the plurality of light sources, if any, are illuminated, and the new set of illuminated light source(s), if any, remain illuminated until a next activation of the switch.

9. A flashlight according to claim 1, wherein each activation of the switch changes a characteristic of the light beam.

10. A flashlight according to claim 1, wherein the integrated circuit only changes state when a signal is input from the switch.

11. A flashlight, comprising:

a flashlight body that is hand-sized;

plural light sources disposed within the flashlight body;

a switch disposed on the flashlight body; and a multi-state electronic device that has plural states and is electrically coupled to the switch and to the plural light sources, wherein the flashlight body is configured to direct light from the plural light sources, wherein each activation of the switch causes the multi-state electronic device to advance to a next one of the plural states, wherein the multi-state electronic device only changes state when a signal is input from the switch, and wherein each of the plural states causes a different combination of the light sources to illuminate.

12. A flashlight according to claim 11, wherein the multi-state electronic device is a counter having an output corresponding to each state.

13. A flashlight according to claim 11, wherein at least some of the light sources have different brightnesses.

14. A flashlight according to claim 11, wherein the light sources comprise an incandescent lamp and a light-emitting diode.

15. A flashlight according to claim 11, wherein at least one of the light sources is covered by a type of lens that does not cover at least one other of the light sources.

16. A flashlight according to claim 11, wherein the flashlight body is configured to direct light from the plural light sources in a single direction.

17. A flashlight according to claim 11, wherein the switch is a pushbutton.

18. A flashlight according to claim 11, wherein the switch is a three-position rocker switch, depressing the switch in a first direction advances to a next state of the multi-state device, and depressing the switch in a second direction returns to a previous state of the multi-state device.

19. A flashlight according to claim 11, wherein depressing the switch in the first direction causes a characteristic of a resulting light beam to change in one direction and depressing the switch in the second direction causes the characteristic of the resulting light beam to change in an opposite direction.

20. A flashlight according to claim 11, wherein the flashlight is battery-powered.

21. A flashlight according to claim 11, wherein each time the switch is activated the multi-state electronic device causes a change in which of the plurality of light sources, if any, are illuminated, and the new set of illuminated light source(s), if any, remain illuminated until a next activation of the switch.

22. A flashlight according to claim 11, wherein the multi-state electronic device cycles through at least three different states in response to said identical activations of the switch.

23. A flashlight according to claim 11, wherein for each transition from a previous state to a new state, based on an activation of the switch, the multi-state electronic device causes a different pattern of light sources to illuminate and to remain illuminated until a next state transition based on an activation of the switch.

24. A flashlight according to claim 11, wherein the switch is spring-loaded and a depression and release of the switch causes only a single state change in the multi-state electronic device.

25. A flashlight according to claim 11, wherein the switch is a temporary-activation switch and only a single transition edge of the signal provided by the switch causes a state change in the multi-state electronic device.

26. A flashlight according to claim 11, wherein the plural states begin at an initial state in which all of the light sources are off and then, after cycling through the fixed number of states, return to said initial state, whereupon the cycle may be repeated.

* * * * *

UNITED STATES PATENT AND TRADEMARK OFFICE

CERTIFICATE OF CORRECTION

PATENT NO. : 6,890,086 B2
DATED : May 10, 2005
INVENTOR(S) : Stephanie Wai Man Shiu It is certified that error appears in the above-identified patent and that said Letters Patent is hereby corrected as shown below:

Column 5,
Line 61, change “chances” to -- changes --.

Column 7,
Line 4, change “11” to -- 18 --.

Signed and Sealed this

Twenty-third Day of August, 2005

JON W. DUDAS
*Director of the United States Patent and Trademark Office*